US007097248B2

(12) United States Patent
Voss

(10) Patent No.: US 7,097,248 B2
(45) Date of Patent: Aug. 29, 2006

(54) SEATING DEVICE IN THE FORM OF SEAT FURNITURE OR FOR PLACING ON SEAT FURNITURE

(76) Inventor: Klaus-Dieter Voss, 94, Schwaketenstrasse, 78467 Constance (DE)

( * ) Notice: Subject to any disclaimer, the term of this patent is extended or adjusted under 35 U.S.C. 154(b) by 321 days.

(21) Appl. No.: 10/398,881

(22) PCT Filed: Oct. 8, 2001

(86) PCT No.: PCT/EP01/11595

§ 371 (c)(1),
(2), (4) Date: Aug. 22, 2003

(87) PCT Pub. No.: WO02/30241

PCT Pub. Date: Apr. 18, 2002

(65) Prior Publication Data

US 2004/0036332 A1 Feb. 26, 2004

(30) Foreign Application Priority Data

Oct. 11, 2000 (DE) ..... 100 50 249

(51) Int. Cl.
*A47C 1/023* (2006.01)

(52) U.S. Cl. ..... 297/313; 297/337

(58) Field of Classification Search ..... 297/313, 297/325, 326, 337, 344.1; 248/429
See application file for complete search history.

(56) References Cited

U.S. PATENT DOCUMENTS

| | | | | | |
|---|---|---|---|---|---|
| 2,025,436 | A | * | 12/1935 | Brosset | 297/326 |
| 2,310,346 | A | * | 2/1943 | Bell | 248/408 |
| 3,286,971 | A | * | 11/1966 | Walter et al. | 248/429 |
| 4,589,699 | A | * | 5/1986 | Dungan | 297/423.12 |
| 4,648,654 | A | * | 3/1987 | Voss | 297/313 |
| 4,796,951 | A | * | 1/1989 | Tamura et al. | 297/337 |
| 4,915,447 | A | * | 4/1990 | Shovar | 297/284.11 |
| 5,024,485 | A | | 6/1991 | Berg et al. | |
| 5,035,466 | A | * | 7/1991 | Mathews et al. | 297/337 |
| 6,027,168 | A | * | 2/2000 | Crossman et al. | 297/337 |
| 6,135,556 | A | * | 10/2000 | Chu et al. | 297/337 |

FOREIGN PATENT DOCUMENTS

| | | |
|---|---|---|
| DE | 299 01 774 | 4/1999 |
| FR | 1 318 720 | 2/1963 |
| WO | WO 93/19648 | 10/1993 |
| WO | WO 00/45675 | 8/2000 |

* cited by examiner

*Primary Examiner*—Peter R. Brown
(74) *Attorney, Agent, or Firm*—Bachman & LaPointe, P.C.

(57) ABSTRACT

A seating device in the form of seat furniture or for placing on seat furniture. The device comprises a seating element which can be pivoted transversally to the seating direction in relation to a support element about at least one axis. The seating element can be moved in the seating direction (X) in relation to the support element by means of at least one actuatable regulating device, and a regulated self-locking position is fixed.

9 Claims, 5 Drawing Sheets

R1
1.3
5.1
1.1
3
13
12
11
2
1.2
8
5.2
1.4
4

R1
13
12
4
6
3
2
5.1
1.1
13
8
21
7

4
1.4
5.2
1.2
3
13
11
12
2
13
1.1
8
5.1
13
R1

R2
X

R3
X

R3
X 16.2
2
3
4
8
13
16.1
17
18
19

SEATING DEVICE IN THE FORM OF SEAT FURNITURE OR FOR PLACING ON SEAT FURNITURE

BACKGROUND OF THE INVENTION

The present invention relates to a seating arrangement as a piece of seating furniture or for placing on a piece of seating furniture, having a seat part which can be pivoted about at least one shaft, transversely to the seating direction, in relation to a support element.

Such seating arrangements are available on the market, and in common use, in a wide variety of different forms and configurations. For this purpose, you are referred to German Utility Model DE 299 01 774 and to German Patent Application DE 100 03 843. These describe a similar seating arrangement for placing on a piece of seating furniture, for example, as a dynamic seating aid. The disadvantage is that, in particular, a linear movement of the seat part only takes place with very high outlay in terms of equipment, which is undesirable. For this purpose, a very large number of components are necessary in order for an adjustment of the seat part in a linear manner in relation to a support element to be allowed and, at the same time, secured.

DE 299 01 774 describes a seating arrangement which is intended for placing on a piece of seating furniture and in the case of which the seat part can be displaced with latching action in three different steps in relation to the support part.

FR 1 318 720 describes a piece of seating furniture of which the seat surface can be inclined about an axis.

U.S. Pat. No. 5,024,485 discloses a support for a piece of seating furniture, on the support surface of which two separate seat parts can be inclined independently of one another about an axis. A similar piece of seating furniture is described in WO 93/19648.

The object of the present invention is to provide a seating arrangement of the type mentioned in the introduction which does away with the abovementioned disadvantages and by means of which it is easily possible for the seat part to be moved in relation to the support element, with the result that the seat part is easy to operate and cost-effective to produce. It is further intended for damping and adjustment of the inclination of the seat part in relation to a support element to be possible in a very cost-effective, straightforward and effective manner.

SUMMARY OF THE INVENTION

The present invention is an improvement of the seating arrangement described in DE 100 03 843 which is incorporated herein by reference.

The essential feature of the present invention is that, by means of an adjusting device which may be designed as a self-locking gear mechanism, the seat part is adjusted in a stepless manner in the seating direction in relation to the support element. It is possible here for the seat part to be moved back and forth in a stepless and self-locking manner by the actuation of an actuating element. In this case, an adjusting device is preferably arranged diagonally on the seat part, in which case a drive slide can be moved in relation to an accommodating bearing. The drive slide is driven via a spindle element by virtue of the shaft being rotated.

The slide is moved back and forth along the shaft by the movement of the spindle element, and thus displaces the seat part in the the drive slide exerts pressure on the accommodating bearings of the adjusting device. It is thus possible, in a self-locking manner, for a stepless movement of the seat part to take place in relation to the support element, since the seat part is likewise mounted on the shaft via bearing elements with slots.

It has further proven particularly advantageous in the case of the present invention for at least one damping element, which is for example pneumatically actuatable, to be arranged between the seat part and support element. This makes it possible to damp a tilting movement of the seat part in relation to the support element or for a quite specific inclination or an angle of inclination of the seat part to be set in a defined manner in relation to the support element. The damping elements are preferably secured between the seat part and support element by means of fixed/moveable bearing arrangements and guided linearly in the seating direction, if appropriate, in guide rails, guide elements or the like, in order that the seat part can still be moved linearly in relation to the support element. The damping elements may be cylinder elements, damping members, for example also rubber cylinders, rubber balls, etc., which can be actuated in a manual and/or elastic and also compressible or non-compressible manner.

The idea of the present invention is also intended to cover the position of a plurality of adjusting devices, which may be spaced apart from one another, for example, in the region of the bearing elements.

It should also lie within the scope of the present invention for it to be possible for the seating arrangement to be designed as an independent piece of seating furniture or for placing on a piece of seating furniture. If the seating arrangement is designed as a piece of seating furniture, then it is possible, for example, for a chair framework, chair legs or an office-chair support structure to be connected to the support element from beneath.

If the seating arrangement is designed as a support for subsequently placing on a piece of seating furniture, then it is possible for the support element just to rest thereon or to be spaced apart from an underlying surface, for example, by means of base elements (not illustrated). This should likewise lie within the scope of the present invention.

It has also proven advantageous to ensure linear guidance by means of adjacent bearing elements which are in contact with one another and belong to the seat part and support element.

BRIEF DESCRIPTION OF THE DRAWINGS

Further advantages, features and details of the invention can be gathered from the following description of preferred exemplary embodiments and with reference to the drawings, in which.

DETAILED DESCRIPTION

Figure 1:
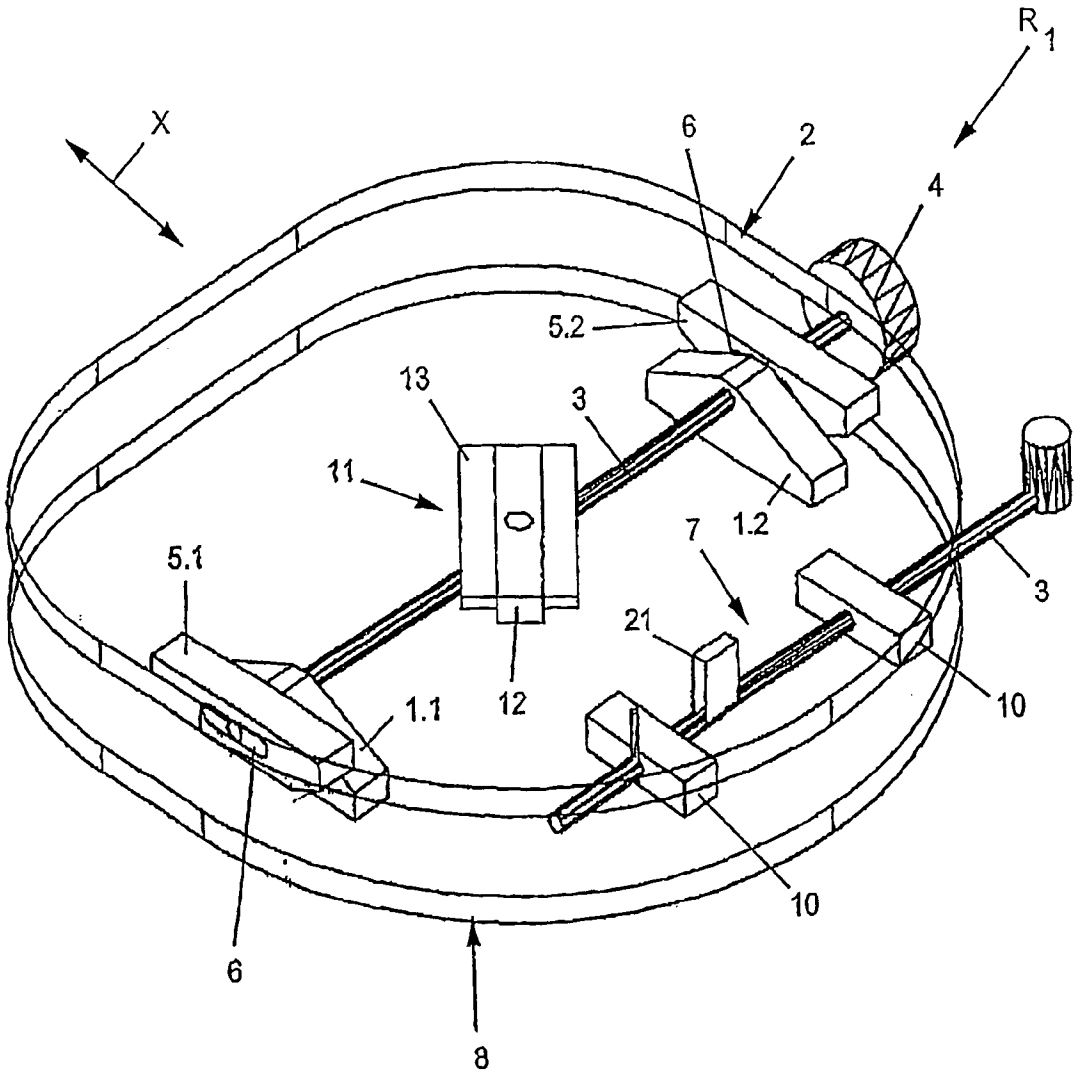
FIG. 1 shows a schematically illustrated perspective view of a seating arrangement.

According to FIG. 1, a seating arrangement $R_1$ according to the invention has a seat part 2 which can be tilted via a shaft 3, transversely to a seating direction X, in relation to a support element 8. The shaft 3 is mounted in a radially moveable manner in bearing elements 1.1, 1.2 and is secured in an axially non-displaceable manner therein. Connected to the end side of the shaft 3 is an actuating element 4, which may be a grip element, a handle, a hand wheel, an electrically operated motor or the like, for the purpose of rotating the shaft 3 radially.

The bearing elements 1.1, 1.2 are fixed to the support element 8. The seat part 2 is likewise assigned bearing elements 5.1, 5.2, which are fixed to the seat part 2, in particular a bottom surface. In this case, the bearing elements 5.1, 5.2 are provided with a slot 6, in which the shaft 3 and the bearing elements 5.1, 5.2 are mounted such that they can be moved back and forth linearly in the seating direction X.

Furthermore, a securing device 7 is provided outside the region of the shaft 3, preferably in the center, a securing shaft 9 being mounted in a rotatable manner in bearing blocks 10, and a stub element 21 for spacing-apart and fixing purposes preventing of a tilting movement about the shaft 3 of the seat part 2 in relation to the support element 8 and/or setting a fixed position.

Figure 2:
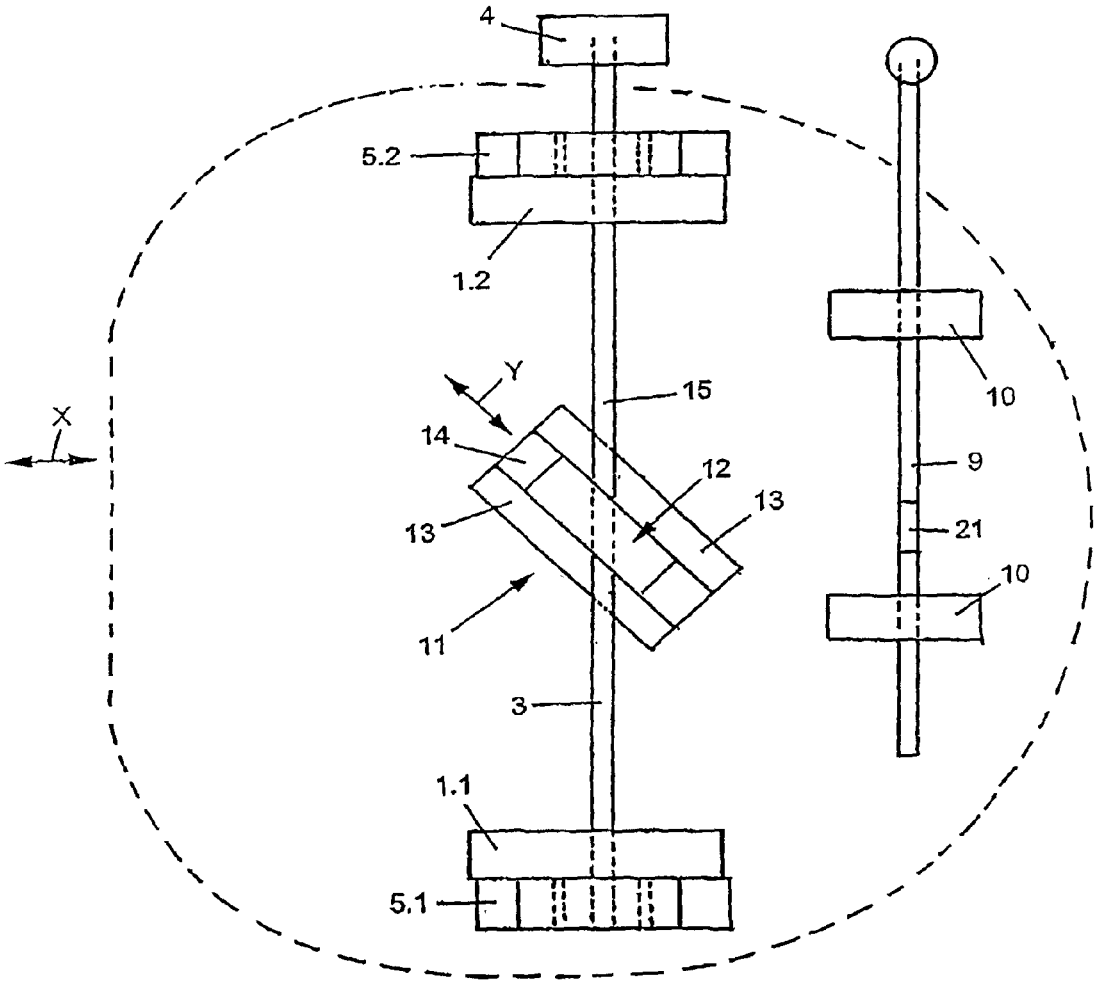
FIG. 2 shows a schematically illustrated plan view of the seating arrangement according to FIG. 1.

The essential factor, however, in the case of the present invention, as is indicated in particular also in FIG. 2, is for the seat part 2 preferably to be assigned an adjusting device 11, which is assigned to the seat part 2 preferably diagonally to the seating direction X.

In this case, the adjusting device 11 is formed from a drive slide 12 which is mounted such that it can be displaced in a groove 12, in the Y-direction illustrated, in relation to at least one accommodating bearing 13. The shaft 3 engages merely in the drive slide 12 and is designed as a spindle element 15 at least in the region of the adjusting device 11. In this case, the spindle element 15 engages in a corresponding matching thread (not illustrated specifically here) of the drive slide 12.

The present invention functions as follows:

By virtue of the shaft 3 or of the spindle element 5 being rotated by means of the actuating element 4, in a manual and/or automatic, for example electrically operated, manner, the drive slide 12, depending on the direction of rotation of the shaft 3, is moved back and forth axially on the latter. By virtue of the axial back and forth movement of the drive slide 12, and in particular by virtue of the diagonal arrangement of the adjusting device 11, the drive slide 12 exerts pressure on the accommodating bearings 13 and thus moves the seat part 2 in the seating direction X in relation to the support element 8. In this case, the shaft 3, rather than being mounted in an axially moveable manner in the bearing elements 1.1, 1.2, is mounted in a merely radially moveable manner therein.

Figures 3, 4, 5:
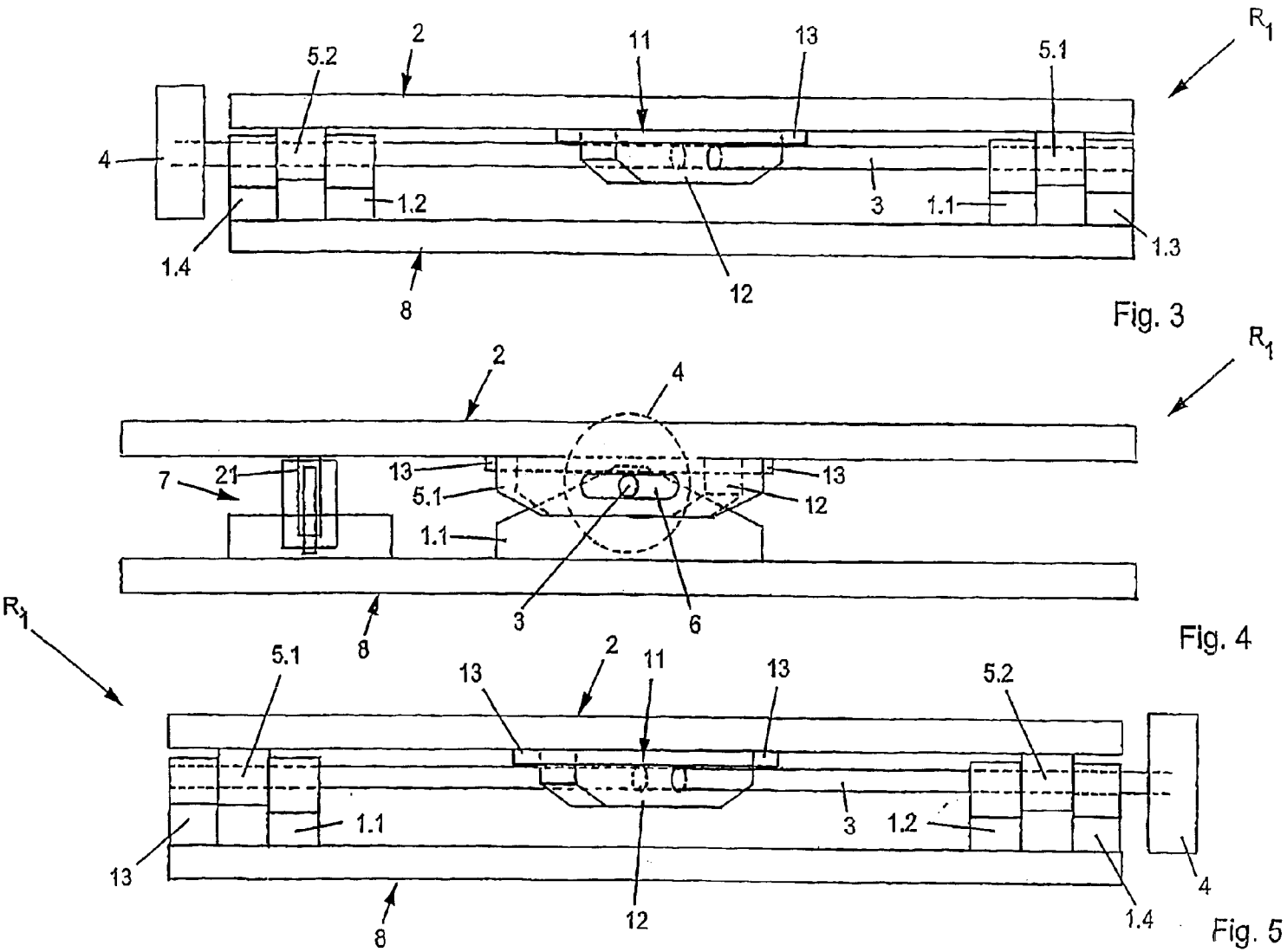
FIG. 3 shows a schematically illustrated front view of the seating arrangement according to FIGS. 1 and 2.
FIG. 4 shows a schematically illustrated side view of the seating arrangement according to FIGS. 1 and 2.
FIG. 5 shows a schematically illustrated rear view of the seating arrangement according to FIGS. 1 and 2.

The exemplary embodiment of the present invention according to FIG. 3 illustrates how the adjusting device 11 with drive slide 12 and accommodating bearing 13 is arranged on the bottom of the seat part 2.

It can also be seen that the bearing elements 1.1, 1.2 of the support element 8 directly adjoin the bearing elements 5.1, 5.2 of the seat part 2. The shaft 3 engages in the corresponding slots 6 of the bearing elements 5.1, 5.2. In order to assist linear guidance and, in particular, linear movement of the seat part 2 in the seating direction X illustrated, see FIGS. 1 and 2, in relation to the support element 8, additional bearing elements 1.3 and 1.4 may be assigned to the support element 8, with the result that the bearing elements 5.1, 5.2 of the seat part 2 are guided linearly in a precisely fitting manner therebetween, thus permitting merely a linear movement of the seat part 2 and/or a tilting movement about the shaft 3, in the seating direction X illustrated, in relation to the support element 8. FIG. 4 illustrates, in the side view, how it is possible for the securing device 7 to secure a tilting movement in at least one direction.

FIG. 5 shows the corresponding rear view of the arrangement $R_1$, which is approximately symmetrical to the front view according to FIG. 3.

Figures 6, 7, 8:
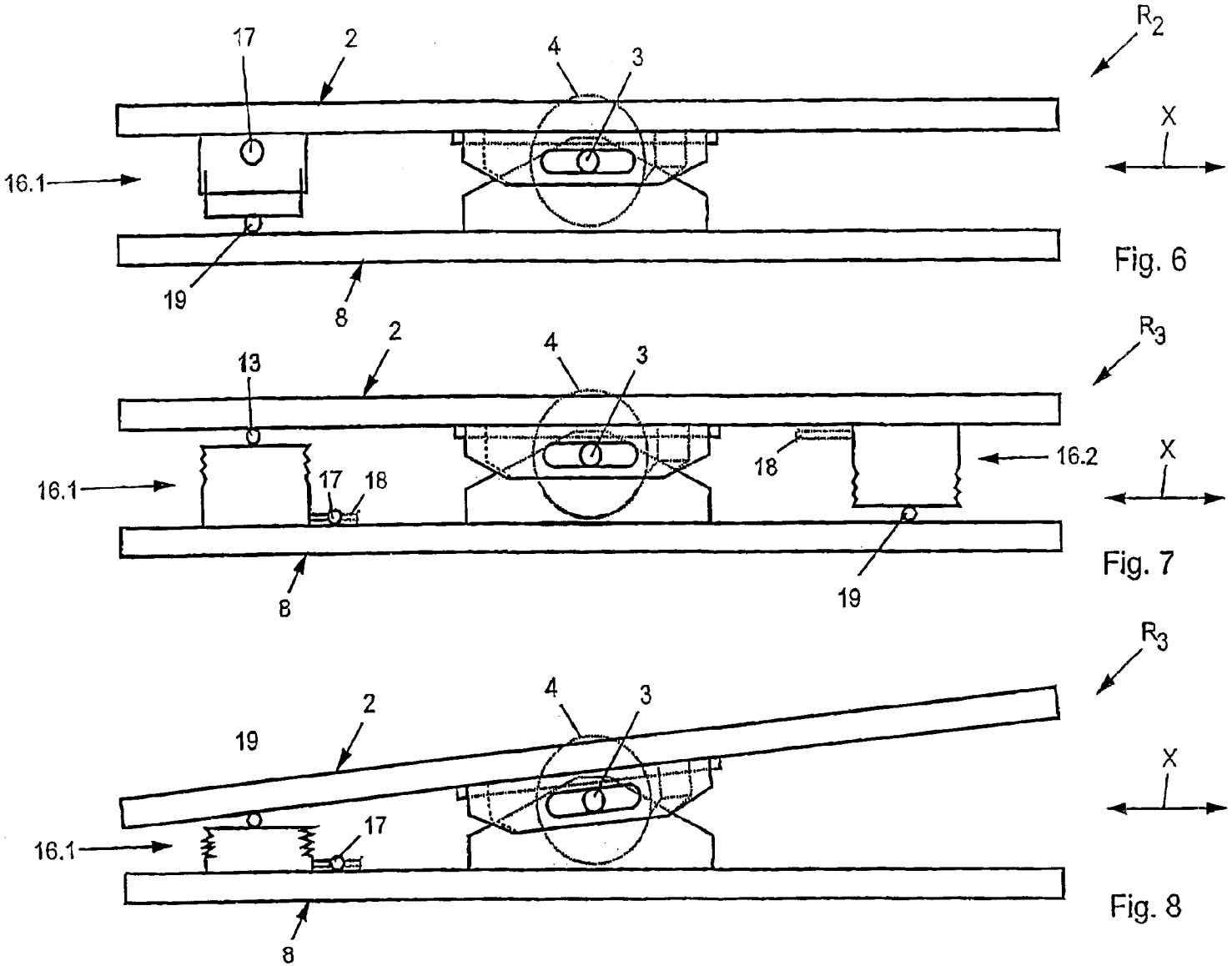
FIG. 6 shows a schematically illustrated side view of a further exemplary embodiment of the seating arrangement according to FIGS. 1 and 2.
FIG. 7 shows a schematically illustrated side view of a further exemplary embodiment of the seating arrangement according to FIGS. 1 and 2.
FIG. 8 shows a schematically illustrated side view of the seating arrangement according to FIG. 6 in a different use position.

In the exemplary embodiments of the present invention according to FIGS. 6 and 7, at least one damping element 16.1, 16.2, which is preferably designed as a pneumatic cylinder, is inserted between the seat part and support element 8 of the arrangements $R_2$ and $R_3$. It is also possible here for the damping element 16.1, 16.2 to be of elastic nature. In FIG. 7, in each case two damping elements 16.1, 16.2 are arranged between the seat part 2 and support element 8, on either side of the shaft 3 in each case.

The two damping elements 16.1, 16.2 can preferably be actuated pneumatically by manual and/or automatic means, for example using an electrically operated air pump. A manually or automatically actuatable restrictor valve 17 may be assigned directly or indirectly to the damping element 16.1, 16.2 in order, for example in the case of pressure activation, for air to be let slowly out of the damping element 16.1, 16.2, so as to damp a movement, in particular a tilting movement of the seat part 2 about the shaft 3 in relation to the support element 8.

It is also possible for a quite specific inclination of the seat part 2, as is illustrated for example in FIG. 8, to be secured in a desired position by virtue of the restrictor valve 17 being closed.

If two damping elements 16.1, 16.2 are [lacuna], as is illustrated for example in FIG. 7, then these may be connected to one another via a connecting line 18, which is indicated here by dashed lines, with the result that, for example in the case of a tilting movement in the case of, for example, one damping element 16.1 being compressed, the air passes into the expanding damping element 16.2 via the restrictor valve 17 and the connecting line 18 and damping is possible as a result.

Furthermore, it should be possible for the damping elements 16.1, 16.2 also to be operated by means of non-compressible media, for example hydraulic fluids or the like.

Damping then takes place via the corresponding restrictor valve, by means of which it is possible to make a precise setting as to how quickly or with what level of damping the seat part 2 is to be tilted about the shaft 3 in relation to the support element 8. Once a desired inclination of the seat part 2 has been achieved, then the restrictor valve 17 is closed. In particular in the case of non-compressible media, it is then no longer possible for the seat part 2 to be moved in relation to the support element 8. It may thus be advantageous to use compressible media, such as gas or, in particular, air, in order also to ensure a certain rocking action of the seat part 2 when someone is sitting thereon. This should likewise lie within the scope of the present invention.

Figure 9:
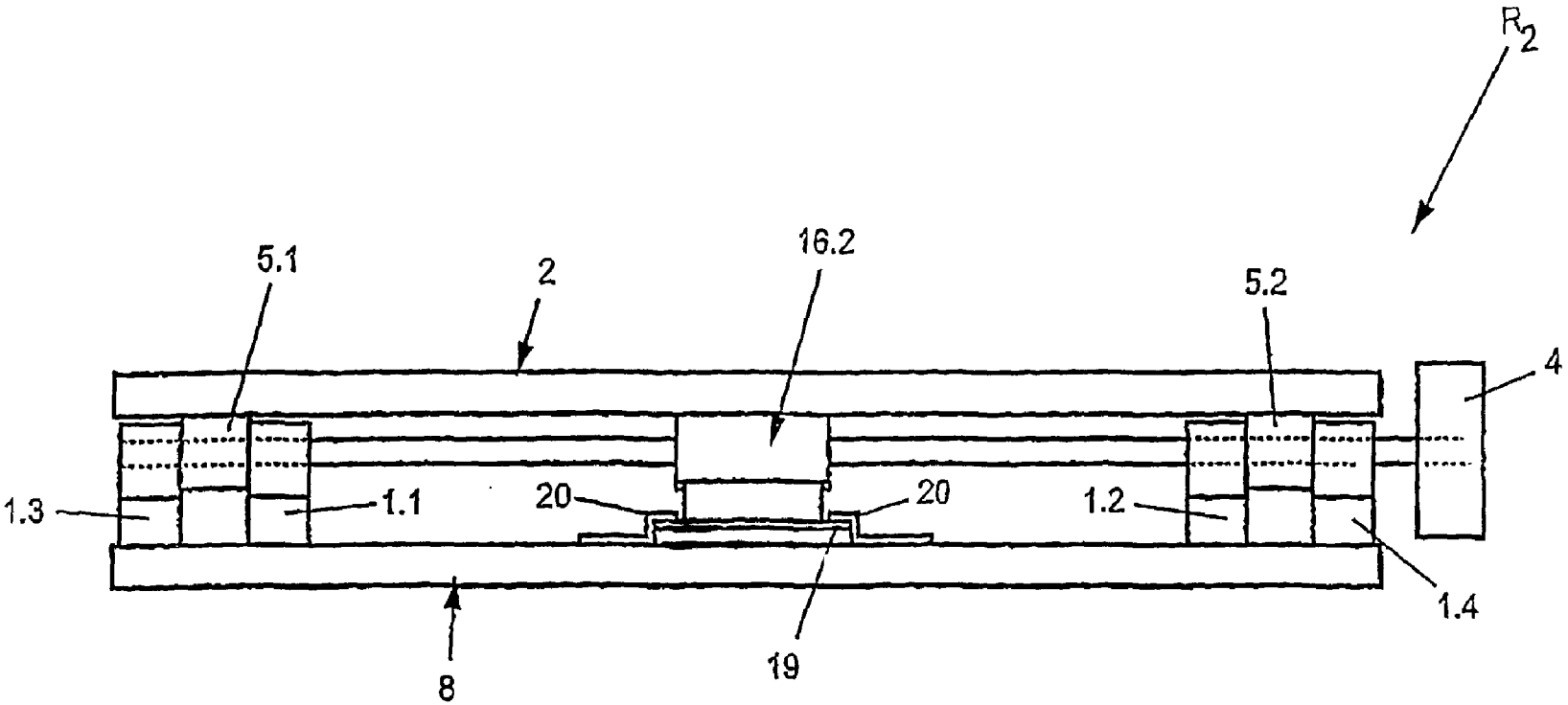
FIG. 9 shows a rear view of the seating arrangement according to FIG. 6 in a rest position.

Furthermore, it should be possible for the damping elements 16.1, 16.2 to be fixed to the seat part 2 and connected to the support element 8 such that they can be moved linearly in the seating direction X, it then being possible for an articulation 19 to be connected to the support element 8 as a moveable bearing, for example, such that it can be guided linearly in the seating direction X. The guidance is illustrated, for example, in FIG. 9, the articulation 19 being mounted such that it can be moved linearly in guide rails 20. In FIGS. 7 and 8, the idea is for the damping element 16.1 to be fixed to the support element 8 and for the articulation 19 to be secured in an articulated manner, for linear displacement, to the seat part 2. This may likewise take place, as is not illustrated any more specifically here, via the guide rails 20 illustrated in FIG. 9. It should also be possible to use corresponding guide grooves or the like. The invention should not be limited in any way here.

In the case of the present invention, the seating arrangement $R_1$, $R_2$ may be used as a piece of seating furniture or for placing on any desired piece of seating furniture.

If the seating arrangement $R_1$, $R_2$ is designed, for example, as the piece of seating furniture itself, then a substructure or at least one base element may be connected to the support element in a known manner.

For example, office-chair substructures, a plurality of base elements, bar-stool-like frameworks or the like may be connected thereto in order to form a corresponding seating arrangement. It is then also possible, if appropriate, for a backrest to be fitted on the support element 8, in a manner which has not been illustrated. This should likewise lie within the scope of the present invention. However, it may also be possible for a backrest to be fitted on the moveable seat part 2, should this be desired.

If the seating arrangement $R_1$, $R_2$ is designed as a support for a piece of seating furniture, then this may be placed directly with the support element 8 on a seat surface of a chair. It should also be possible, however, for the support element 8 to be provided with a plurality of base elements, in order to create a low-level piece of seating furniture or a low-level support for a piece of seating furniture.

The invention claimed is:

1. A seat arrangement comprising a support element (8), support means (3) for pivotably mounting a seat part (2) on the support element (8) about a first axis, adjusting means (11) for moving the seat part relative to the support element in a direction (X) which is substantially transverse to the first axis, and locking means for securing the seat part in a position relative to the support element, the adjusting means is located between the seat part and the support means and is connected to the seat part (2), wherein the adjusting means is movable along an axis (Y) which is diagonal to the direction (X).

2. A seat arrangement as claimed in claim 1, wherein the adjusting means (11) comprises a drive slide (12) which is displaceably mounted on a bearing (13) which is fixed to the seat, the drive slide (12) has a threaded portion for engaging a spindle element (15) for moving the slide along axis (Y).

3. A seat arrangement as claimed in claim 2, wherein the spindle element (15) is radially rotatable and axially secured in an at least one bearing element (5.1, 5.2) and an actuating element (4), is connected to the spindle.

4. A seat arrangement as claimed in claim 1, wherein at least one damping element (16.1) is provided between the seat part (2) and support element (8).

5. A seat arrangement as claimed in claim 4, wherein the damping element (16.1, 16.2) is one of pneumatic and hydraulic.

6. A seat arrangement as claimed in claim 5, wherein a restrictor valve (17) for opening and closing the at least one damping element (16.1, 16.2) is connected thereto.

7. A seat arrangement as claimed in claim 5, wherein two damping elements (16.1, 16.2) are located on either side of the support means (3), and are connected to one another via at least one connecting line (18) and at least one restrictor valve (17) is inserted into the connecting line (18).

8. A seat arrangement as claimed in claim 4, wherein the at least one damping element (16.1, 16.2) is mounted in a fixed manner on one of the seat part (2) and the support element (8) with the seat part (2).

9. A seat arrangement as claimed in claim 1, wherein the seat part (2) has two spaced-apart bearing elements (5.1, 5.2) for accommodating the support means (3) of the support element (8) for guiding a linear movement of the seat part (2) in the direction (X).

* * * * *